US008866638B2

(12) United States Patent
Weigert et al.

(10) Patent No.: US 8,866,638 B2
(45) Date of Patent: Oct. 21, 2014

(54) ACQUISITION OF TRAVEL- AND VEHICLE-RELATED DATA

(75) Inventors: Norman J. Weigert, Whitby (CA); Vyacheslav Berezin, Newmarket (CA); Kier M. Mathieson, Grosse Pointe Farms, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 425 days.

(21) Appl. No.: 13/113,428

(22) Filed: May 23, 2011

(65) Prior Publication Data

US 2012/0299750 A1 Nov. 29, 2012

(51) Int. Cl.

| | |
|---|---|
| ***G08G 1/065*** | (2006.01) |
| ***G08G 1/01*** | (2006.01) |
| *G07C 5/00* | (2006.01) |

(52) U.S. Cl.

CPC ..... *G08G 1/0112* (2013.01); *G07C 5/008* (2013.01); *G08G 1/0141* (2013.01)

USPC ..... 340/934; 340/936; 701/117; 701/118; 701/119; 455/456.1; 455/457; 455/458

(58) Field of Classification Search

CPC ... G08G 1/0141; G08G 1/0112; G08G 1/091; G08G 1/0133; G08G 1/09675; G08G 1/096716; G08G 1/096775; G08G 1/20; G08G 1/0104

USPC ..... 340/934

See application file for complete search history.

(56) References Cited

U.S. PATENT DOCUMENTS

| | | | | |
|---|---|---|---|---|
| 5,182,555 | A * | 1/1993 | Sumner | 340/905 |
| 6,177,886 | B1 * | 1/2001 | Billington et al. | 340/934 |
| 6,285,949 | B1 * | 9/2001 | Roediger | 701/117 |
| 6,577,946 | B2 * | 6/2003 | Myr | 701/117 |
| 6,587,781 | B2 * | 7/2003 | Feldman et al. | 701/117 |
| 6,810,321 | B1 * | 10/2004 | Cook | 701/117 |
| 7,042,369 | B2 * | 5/2006 | Hill et al. | 340/942 |
| 7,580,788 | B2 * | 8/2009 | Hiruta et al. | 701/117 |
| 7,583,818 | B2 * | 9/2009 | Hegedus et al. | 382/104 |
| 7,606,185 | B2 * | 10/2009 | Saito | 370/310 |
| 7,885,599 | B2 * | 2/2011 | Yuhara et al. | 455/3.01 |
| 7,899,612 | B2 * | 3/2011 | Kumagai et al. | 701/117 |
| 8,041,779 | B2 * | 10/2011 | Habaguchi et al. | 709/219 |
| 8,180,558 | B1 * | 5/2012 | Marko | 701/119 |
| 8,209,114 | B2 * | 6/2012 | Ishikawa et al. | 701/118 |
| 8,260,320 | B2 * | 9/2012 | Herz | 455/456.3 |
| 8,358,222 | B2 * | 1/2013 | Gueziec | 340/905 |
| 8,405,521 | B2 * | 3/2013 | Fujiwara et al. | 340/905 |
| 2003/0014181 | A1 * | 1/2003 | Myr | 701/117 |
| 2004/0249559 | A1 * | 12/2004 | Mintz | 701/117 |
| 2005/0132024 | A1 * | 6/2005 | Habaguchi et al. | 709/219 |
| 2006/0206256 | A1 * | 9/2006 | Kumagai et al. | 701/117 |
| 2007/0043500 | A1 * | 2/2007 | Chen | 701/117 |
| 2008/0074290 | A1 * | 3/2008 | Woo et al. | 340/934 |

(Continued)

*Primary Examiner* — Mohammad Ghayour
*Assistant Examiner* — Adnan Aziz
(74) *Attorney, Agent, or Firm* — Cantor Colburn LLP

(57) ABSTRACT

Data acquisition from a sampling of vehicle sensors includes identifying a vehicle population density for a defined region, calculating a proportional representation ratio from the vehicle population density, and transmitting a request for data over a network. The request includes the response criteria configured with the proportional representation ratio. The data acquisition also includes receiving the data from vehicles that are located in the defined region and that fall within the proportional representation ratio, and which meet the response criteria.

20 Claims, 3 Drawing Sheets

(56) References Cited

U.S. PATENT DOCUMENTS

2009/0271151 A1* 10/2009 O'Neal et al. ..... 702/182
2010/0256903 A1* 10/2010 Johnson ..... 701/209
2011/0115648 A1* 5/2011 Laurgeau et al. ..... 340/934
2011/0173015 A1* 7/2011 Chapman et al. ..... 705/1.1
2011/0260884 A1* 10/2011 Yi et al. ..... 340/870.02
2012/0109506 A1* 5/2012 Fei et al. ..... 701/118

* cited by examiner

ACQUISITION OF TRAVEL- AND VEHICLE-RELATED DATA

FIELD OF THE INVENTION

The subject invention relates to off-board data processing and, more particularly, to acquisition of travel- and vehicle-related data.

BACKGROUND

In automotive applications, telematics refers to a system that combines global positioning system (GPS) tracking and other wireless communications for providing services to various entities. For example, roadside assistance and remote diagnostics are two of the services that may be provided through telematics.

Traditionally, in an automotive telematics application, data from a vehicle is uploaded to a tracking system in response to some trigger, such as a time- or event-based mechanism. However, management of the uploaded data can be difficult when large amounts of data are being provided in response to high-volume traveled areas. Additionally, there is significant potential for redundancy of the data uploaded, such as when multiple vehicles in the same geographic area all send the same data to the tracking system. Further, other vehicle-to-infrastructure communications applications, such as dedicated short-range communications (DSRC), can be very expensive to implement as they utilize a great deal of hardware and network components as part of a complex network infrastructure.

Accordingly, it is desirable to provide a more efficient means to acquire data from vehicles for providing these services.

SUMMARY OF THE INVENTION

In one exemplary embodiment, a system for data acquisition from a sampling of vehicle sensors is provided. The system includes a host system computer and logic executable by the host system computer. The logic is configured to implement a method. The method includes identifying a vehicle population density for a defined region, calculating a proportional representation ratio from the vehicle population density, and transmitting a request for data over a network. The request includes response criteria configured with the proportional representation ratio. The data acquisition also includes receiving the data from vehicles that are located in the defined region and that fall within the proportional representation ratio, and which meet the response criteria.

In another exemplary embodiment, a method for data acquisition from a sampling of vehicle sensors is provided. The method includes identifying a vehicle population density for a defined region, calculating a proportional representation ratio from the vehicle population density, and transmitting a request for data over a network. The request includes response criteria configured with the proportional representation ratio. The data acquisition also includes receiving the data from vehicles that are located in the defined region and that fall within the proportional representation ratio, and which meet the response criteria.

In yet another exemplary embodiment, a computer program product for data acquisition from a sampling of vehicles sensors is provided. The computer program product includes a computer storage medium having instructions embodied thereon, which when executed by a computer cause the computer to implement a method. The method includes identifying a vehicle population density for a defined region, calculating a proportional representation ratio from the vehicle population density, and transmitting a request over a network. The request includes response criteria configured with the proportional representation ratio. The data acquisition also includes receiving the data from vehicles that are located in the defined region and that fall within the proportional representation ratio, and which meet the response criteria.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
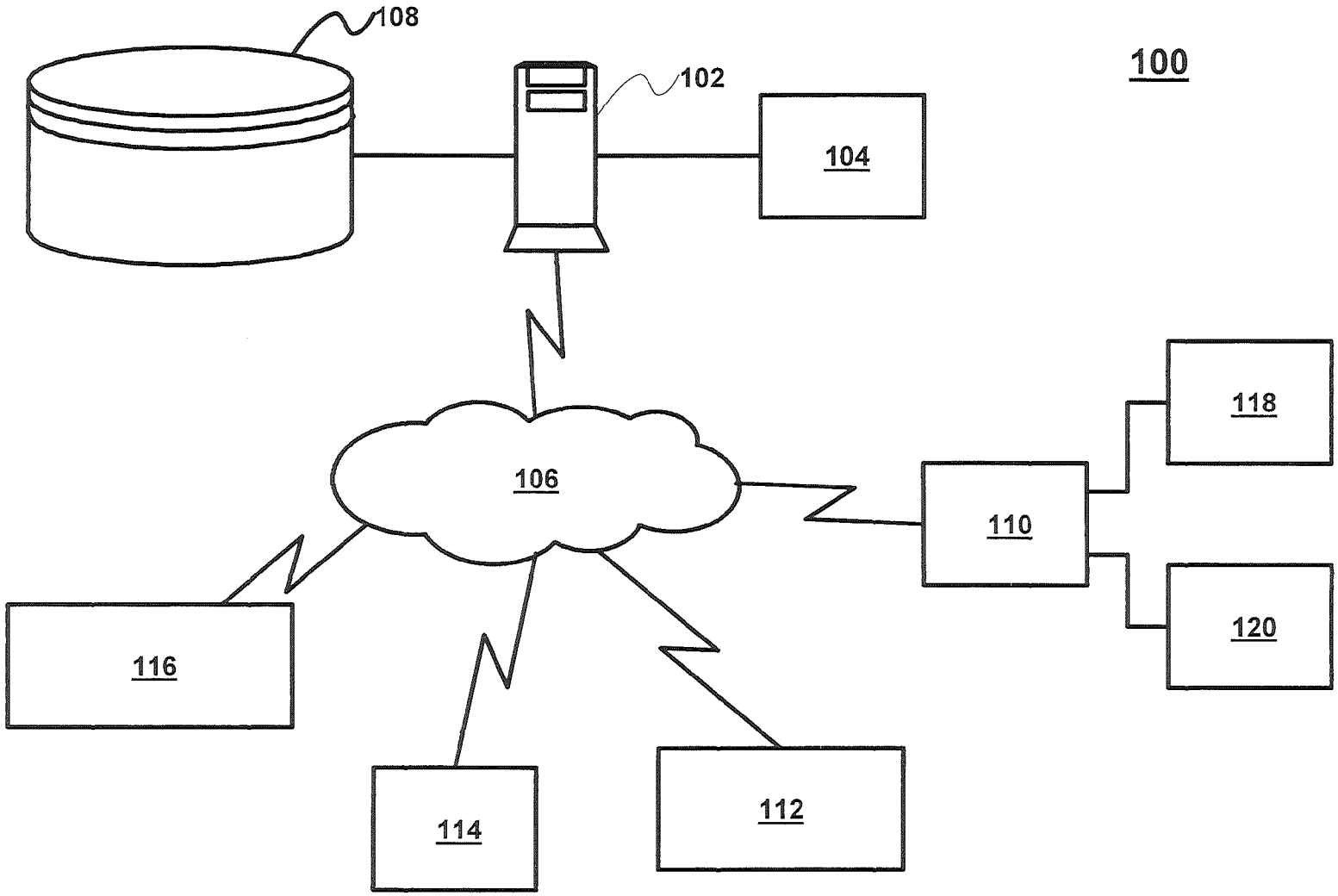
FIG. 1 is a block diagram of a system upon which data acquisition processes may be implemented in accordance with an exemplary embodiment.

The following description is merely exemplary in nature and is not intended to limit the present disclosure, its application or uses. It should be understood that throughout the drawings, corresponding reference numerals indicate like or corresponding parts and features.

In accordance with an exemplary embodiment, acquisition of travel- and vehicle-related data without costly system and network infrastructure components is provided. The data acquisition process transmits a request for information over available existing networks, e.g., digital frequency-modulated (FM) broadcast or satellite networks, whereby the request contains parameters, such as the nature of the data to be collected, a defined region or area of interest targeted by the request from which a response to the request is desired, and response criteria. The data acquisition process minimizes the volume of communication traffic distributed through the networks by calculating a vehicle population density and determining a proportional representation ratio from this population density. In this manner, only select vehicles are asked to respond to the requests, thereby reducing the volume of responses that may otherwise be transmitted over the networks. In an exemplary embodiment, vehicles filter the requests and provide responses only if the response criteria are satisfied. The response criteria are configured to use the proportional representation ratio.

Turning now to FIG. 1, a system 100 upon which the data acquisition process may be implemented will now be described in an exemplary embodiment. In an exemplary embodiment, the system 100 includes a host system 102, vehicles 110, a wireless service provider 112, support devices 114, and communications base stations 116 in communication with networks 106.

The host system 102 may be implemented by a facilitator of the data acquisition process. For example, the data acquisition process may be provided for a specified geographic area, such as a particular state, or may be provided nationally as an inter-network of communication systems and networks. The host system 102 aggregates data requested from vehicles 110 that are located within the region(s) covered by the data acquisition process services offered, as will be described herein. The host system 102 executes an application (e.g., logic 104) for implementing the data acquisition process. The host system 102 may comprise a high-speed computer processing device, such as a mainframe computer, to manage the volume of operations governed by an entity for which the data acquisition process is executing.

The vehicles 110 may include any transport device, such as an automobile or commercial vehicle, such as a commuter bus or other public or private transportation. The vehicles 110 include communication components 118, such as global positioning system (GPS) devices or navigation systems for communicating with digital satellite and/or radio stations as will be described further herein. The vehicles 110 also include sensors 120 that monitor and collect data from various vehicle components. For example, sensors 120 may be vehicle elements that track temperature, vehicle speed, vehicle volume, wiper usage, radio usage, and number of vehicle occupants, to name a few.

The wireless service provider 112 provides pertinent information to travelers across the region serviced by the data acquisition process. In one embodiment, the wireless service provider 112 provides roadside assistance and/or other related services, such as traffic information, roadway conditions, etc. to individuals. In one embodiment, the wireless service provider 112 is a subscription-based service, such as OnStar®. In another embodiment, the functionality of the wireless service provider 112 may be integrated with the host system 102, such that the host system 102 provides the exemplary data acquisition process in conjunction with the roadside assistance and/or other related services.

The support devices 114 provide functions in support of the services offered by the data acquisition process. In one exemplary embodiment, the support devices 114 may be disposed at fixed locations within a region and provide information to the host system 102 over one or more of the networks 106. For example, the support devices 114 may include a camera that captures images of a particular road, such that those who access these images via the host system 102 are able to make commuting decisions, such as identifying alternate routes, delaying a trip, or detouring around a traffic incident. Other support devices 114 may include weather radar antennae The networks 106 may include any type of known networks including, but not limited to, a wide area network (WAN), a local area network (LAN), a global network (e.g., Internet), a virtual private network (VPN), and an intranet. The networks 106 may be implemented using wireless networks or any kind of physical network implementation known in the art. The host system 102, vehicles 110, wireless service provider 112, support devices 114, and communications base stations 116 may be collectively coupled to one another through multiple networks (e.g., Internet, digital or satellite broadcast, cellular, Wifi, etc.) so that not all of the host system 102, vehicles 110, wireless service provider 112, support devices 114, and communications base stations 116 are coupled through the same network.

The storage device 108 includes a data repository with data relating to the data acquisition process, such as user-defined parameters that include the type of data to be collected, response criteria, as well as other data/information desired by the entity representing the host system 102 of FIG. 1. The storage device 108 may be logically addressable as a consolidated data source across a distributed environment that includes networks 106. Information stored in the storage device 108 may be retrieved and manipulated via the host system 102.

The base stations 116 manage and control the over-the-air transmission of data (one-to-many) to devices in their range. The base stations 116 may be implemented using standard communications components, interfaces, and signaling protocols.

As indicated above, the exemplary data acquisition process provides travel- and vehicle-related data without costly system and network infrastructure components. The host system 102 defines an area of interest or geographic region from which data collection is desired. The host system 102 identifies a vehicle population density for a particular region and calculates a proportional representation ratio from this population density. The host system 102 then transmits requests for data. The requests include the type of data subject to the collection and response criteria. The requests are then broadcast by the base stations 116. The vehicles 110 in range of the base stations 116 receive the requests and then filter them according to the response criteria. The vehicles 110 respond to the host system 102 via one or more networks only if the proportional representation ratio and the response criteria are satisfied. These features are described further herein.

Figure 2:
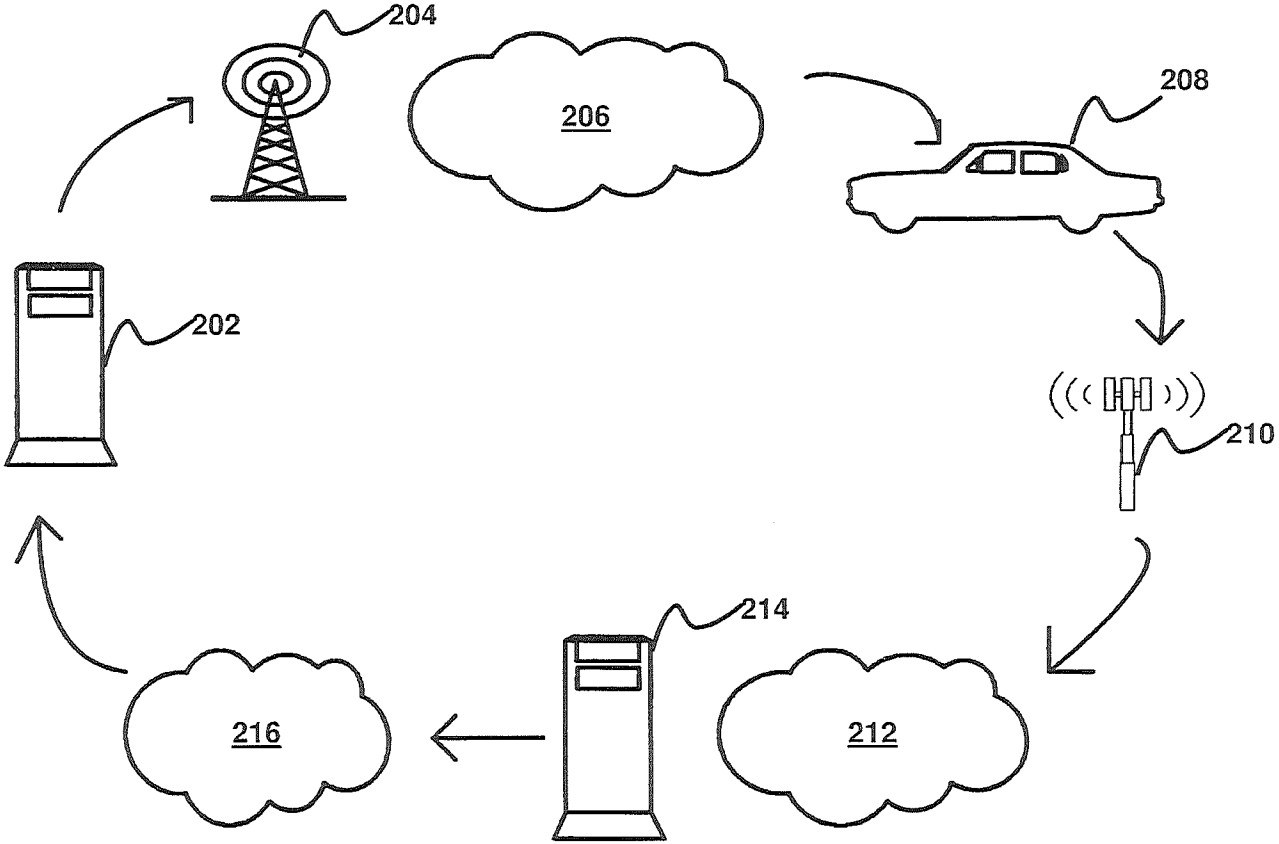
FIG. 2 is a sample system architecture for implementing data acquisition processes in accordance with an exemplary embodiment.
Figure 3:
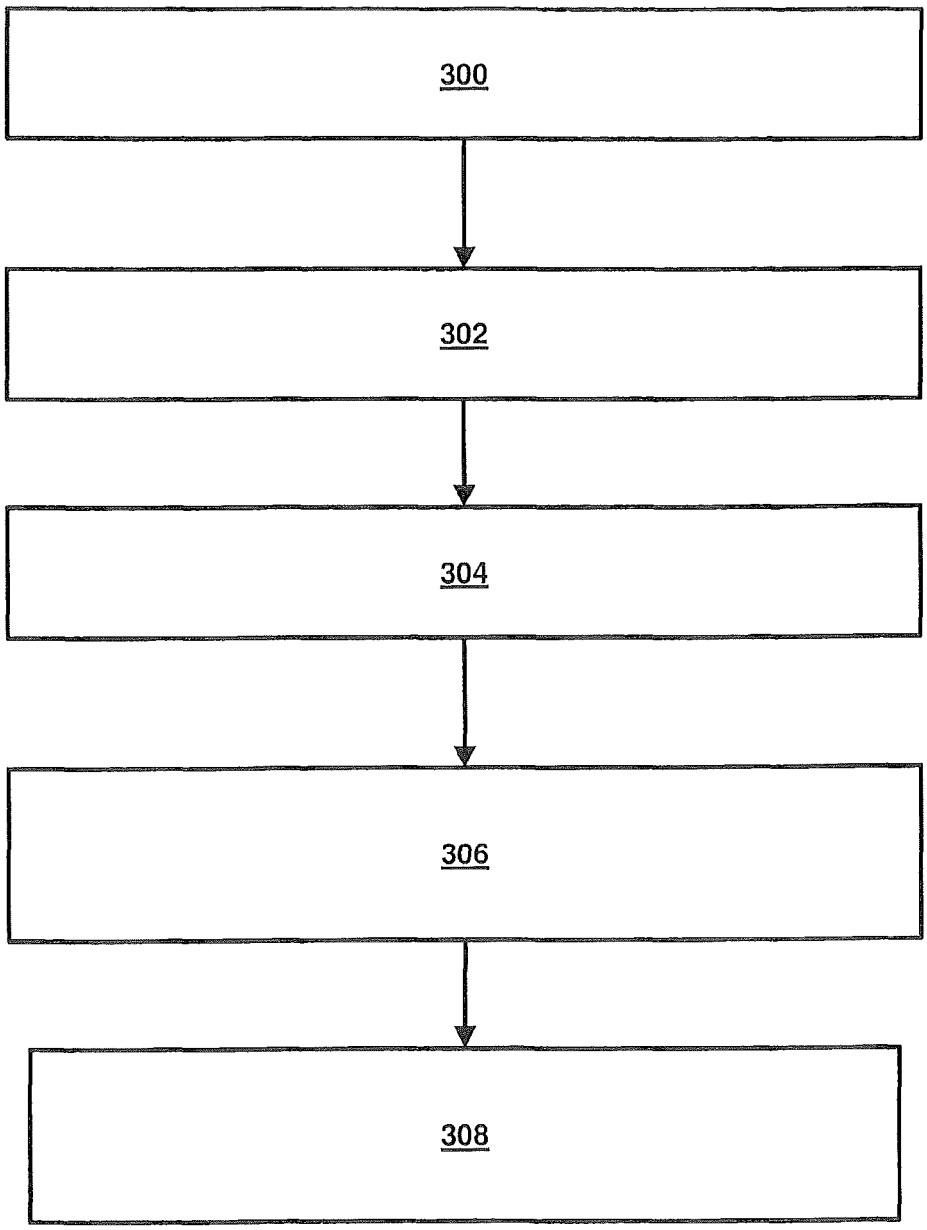
FIG. 3 is a flow diagram illustrating a process for implementing acquisition of travel- and vehicle-related data in accordance with an exemplary embodiment.

Turning now to FIGS. 2 and 3, a sample system infrastructure and process for implementing the data acquisition process will now be described in an exemplary embodiment. It will be appreciated that the sample infrastructure shown in FIG. 2 is for illustrative purposes and is not to be construed as limiting in scope. For example, a variety of types of network and system configurations may be utilized to realize the advantages of the exemplary embodiments.

As illustrated in FIG. 2, a host system 202 implements the data acquisition process. The host system 202, for example, via logic 104 defines an area of interest for which data collection is desired at step 300 and identifies a vehicle population density for that area at step 302. The area of interest may be defined by a geographic boundary or a bounded wireless communication range. For example, the area of interest may be defined as global positioning system coordinates or by distances surrounding specified fixed locations. The population density may be identified using various techniques. For example, the population density may be defined by the U.S. Census Bureau's definition of population density (i.e., urban versus rural areas). Alternatively, or in addition thereto, the population density may be defined using previous data collected in response to requests from the host system 102 (FIG. 1) (or by previously collected data in conjunction with the time of day, day of week, holidays, or other similar types of data). Alternatively, or in conjunction with the above defined elements, the population density may be defined by the number of roads in the area of interest. The above population density determinations are provided for illustrative purposes and are not intended to be limiting in scope. It will be understood that a number of ways of determining population density may be used.

The host system 202 logic calculates a proportional representation ratio from the vehicle population density at step 304. In an exemplary embodiment, the proportional representation ratio is a function of the anticipated volume of vehicles 110 (FIG. 1) in the region at a given point in time.

As shown, e.g., in FIG. 2, the host system 202 logic initiates a request over an FM (frequency modulated) broadcast station 204 (or alternatively, e.g., over an XM/satellite radio), which is then transmitted over a radio data station (RDS) protocol-enabled carrier network 206 (e.g., one of networks 106). The vehicles 208 in range of the broadcast signal transmitted by the FM broadcast station 204 receive the request at step 306. The data requested may relate to a variety of interests. For example, the data requested may include a request for vehicle sensor data, such as vehicle speed, vehicle volume, temperature, windshield wiper usage, radio usage, number of vehicle occupants, tire pressure, emissions data, etc. Other data may be supplemented with the vehicle sensor data. For example, the host system 102 may request data from support devices 114 located in the defined area. Depending upon the type and function of the support device, the type of data requested and collected may include lane occupancy, toll collection information, freight tracking information, roadway conditions, weather conditions, etc. In one embodiment, a support device 114 may be a weather antennae or a camera.

The support device data may be used in conjunction with the data collected from the vehicles 208 in analyzing various events or conditions (weather, road conditions, traffic volume, etc.).

In an exemplary embodiment, the request for data also includes the response criteria. The response criteria may be configured to utilize the proportional representation ratio and a vehicle identification number (VIN). For example, if the proportional representation ratio dictates that data from 10% of the vehicles in an area of interest is desired, the logic 104 (FIG. 1) may be configured to request data from those vehicles in the area having a VIN ending in the number '7'. In this manner, the volume of data transmitted by the base stations in their requests is minimized in that only a portion of the VIN is used in the request. In another embodiment, the data desired for collection may be targeted to specific types of vehicles (e.g., hybrid vehicles). In this embodiment, the request may include a vehicle model qualifier that invites only those vehicles in the area having the qualifier to respond to the request. Thus, the data returned to the host system 102 (FIG. 1) applies only to hybrid vehicles (e.g., the host system 102 desires to know the percentage of vehicles operating in electric mode, and a corresponding vehicle sensor provides this information). The response criteria dictate which of the vehicles 208 will respond to the request. For example, the request for data is transmitted to all vehicles in a network coverage area, e.g., all vehicles within broadcast range of the FM broadcast station 204, and the defined area of interest (e.g., via GPS coordinates) dictates which vehicles are invited to respond to the request. Thus, the response criteria is used to filter a number of the vehicles from which a response is desired. For example, the proportional representation ratio may be calculated to request data from every 'nth' car that passes a particular location. In one non-limiting embodiment, the proportional representation ratio specifies a request for response from every eighth car that passes a particular location on a heavily trafficked road, every third car that passes a particular location on a moderately traveled road, and every car on a lightly traveled road and to ensure adequate sampling (representation) of data collected.

The vehicles 208 that meet the response criteria may respond to the request by sending a short message service (SMS) message to a cellular tower 210 in range of the vehicles 208 via, e.g., the vehicles communication components 118 resident in the vehicles 208. Alternatively, the SMS may be sent using WiFi networking protocols. The SMS message, in turn, is transmitted by the cellular tower 210 over a cellular network 212 (e.g., one of networks 106) to a wireless service provider 214. At step 308, the host system 202 receives the requested data from the wireless service provider 214, e.g., over the Internet 216 (e.g., one of networks 106). The host system 202 may provide individuals with access to this information as a service (e.g., through a website).

The host system logic 104 may be configured to periodically transmit requests for data in order to ensure the most up-to-date information is gathered and available. Alternatively, or in addition thereto, the host system 102 may be configured to transmit a request for data based upon an occurrence of a condition detected in a region, (e.g., a traffic incident, road construction, etc.).

As the tracked vehicles 208 enter a different field of range, e.g., a region serviced by a different base station 116 (FIG. 1), e.g., the FM broadcast station 204, the response criteria may be used to continue to track elements subject to the request for data, as well as other types of requests for data. For example, if the eighth vehicle 208 identified by the proportional representation ratio transmits its vehicle identification number (or a portion thereof) to the host system 102, this information can be used to continue to collect desired data as the vehicle 208 travels into the next serviced region in order to provide continuity of the information gathered and processed by the host system 202.

Technical effects include the ability to acquire information relating to travel conditions without costly system and network infrastructure components. The data acquisition process transmits a request for information over available existing networks, e.g., digital broadcast or satellite networks, whereby the request contains parameters, such as a region targeted by the request from which a response to the request is desired, and vehicle identifiers for vehicles from which responses to the requests are targeted. The data acquisition process minimizes the volume of communication traffic distributed through the networks by calculating a vehicle population density and determining a proportional representation ratio from this population density. In this manner, only select vehicles from select regions are asked to respond to the requests, thereby reducing the volume of responses that may otherwise be transmitted over the networks.

As described above, the invention may be embodied in the form of computer implemented processes and apparatuses for practicing those processes. Embodiments of the invention may also be embodied in the form of computer program code containing instructions embodied in tangible media, such as floppy diskettes, CD-ROMs, hard drives, or any other computer readable storage medium, wherein, when the computer program code is loaded into and executed by a computer, the computer becomes an apparatus for practicing the invention. An embodiment of the invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the application.

What is claimed is:

1. A system for data acquisition from a sampling of vehicle sensors, comprising:

a host system computer; and logic executable by the host system computer, the logic configured to:

identify a vehicle population density representing a number of vehicles in a defined region, each of the vehicles corresponding to the vehicle population density having communication components configured to communicate with the host system computer;

calculate a proportional representation ratio as a percentage of the vehicle population density;

transmit, via at least one of a base station and a satellite system, a request for the data over a network, the request including response criteria configured with the proportional representation ratio, the response criteria specifying which vehicles, of the number vehicles, are directed to respond with the data; and receive the data from the vehicles in the defined region that fall within the proportional representation ratio, and which meet the response criteria.

2. The system of claim 1, wherein the vehicle population density is calculated from population density census data in combination with previously transmitted responses to requests for the data and a number of roads in the defined region.

3. The system of claim 1, wherein the proportional representation ratio is a user-configurable value and is a function of an anticipated volume of vehicles in the defined region at a point in time.

4. The system of claim 1, wherein the network includes at least one of an FM broadcast network and a radio data system protocol-enabled broadcast network, the host system is a telematics service provider, the communications components in the vehicles are implemented as telematics devices, and the response criteria is used to filter a number of the vehicles for responding to the request;

wherein the data is received from the vehicles through the telematics devices.

5. The system of claim 1, wherein the request for the data includes a portion of a vehicle identification number and the response criteria is configured to use the portion of the vehicle identification number to identify the vehicles from which the data is received.

6. The system of claim 1, wherein the logic is further configured to:

communicate, over the network, with a non-vehicle support device in the defined region, the non-vehicle support device including a camera and a weather antenna; and receive data indicating an occurrence of a condition, the condition including weather conditions and at least one of a traffic accident and road construction;

wherein the request for the data is transmitted upon the occurrence of the condition detected in the defined region.

7. The system of claim 1, wherein the data subject to the request includes vehicle speed and at least one of:

temperature;

vehicle volume;

vehicle occupancy;

windshield wiper usage;

radio usage;

lane occupancy;

toll collection information;

freight tracking information;

weather conditions; and roadway conditions.

8. The system of claim 1, wherein the response criteria includes a vehicle type, and the request for the data directs only those vehicles having the vehicle type to respond.

9. The system of claim 1, wherein the logic is further configured to:

provide to subscribers, via a website, access to the data received from the vehicles.

10. The system of claim 1, wherein the logic is further configured to:

communicate, over the network, with a non-vehicle support device in the defined region;

receive at least one of lane occupancy data and toll collection data from the non-vehicle support device; and combine the data from the non-vehicle support device with the data received from the vehicles to determine events and conditions.

11. A method for data acquisition from a sampling of vehicle sensors, comprising:

identifying, via a host system computer, a vehicle population density representing a number of vehicles in a defined region, each of the vehicles corresponding to the vehicle population density having communication components configured to communicate with the host system computer;

calculating a proportional representation ratio as a percentage of the vehicle population density;

transmitting, via at least one of a base station and a satellite system, a request for data over a network, the request including response criteria configured with the proportional representation ratio, the response criteria specifying which vehicles, of the number of vehicles, are directed to respond with the data; and receiving the data from the vehicles in the defined region that fall within the proportional representation ratio, and which meet the response criteria.

12. The method of claim 11, wherein the vehicle population density is calculated from population density census data in combination with previously transmitted responses to requests for the data, and a number of roads in the defined region.

13. The method of claim 11, wherein the proportional representation ratio is a user-configurable value and is a function of an anticipated volume of vehicles in the defined region at a point in time.

14. The method of claim 11, wherein the network is at least one of an FM broadcast network and a radio data system protocol-enabled broadcast network, and the response criteria is used to filter a number of the vehicles for responding to the request.

15. The method of claim 11, wherein the request for the data includes a portion of a vehicle identification number and the response criteria is configured to use the portion of the vehicle identification number to identify the vehicles from which the data is received.

16. The method of claim 11, further comprising:

communicating, over the network, with a non-vehicle support device in the defined region, the non-vehicle support device including a camera and a weather antenna; and receiving data indicating an occurrence of a condition, the condition including weather conditions and at least one of a traffic accident and road construction;

wherein the request for the data is transmitted upon the occurrence of the condition detected in the defined region.

17. The method of claim 11, wherein the data subject to the request includes vehicle speed and at least one of:

temperature;
vehicle volume;
vehicle occupancy;
windshield wiper usage;
radio usage;
lane occupancy;
toll collection information;
freight tracking information;
weather conditions; and
roadway conditions.

18. A computer program product for implementing data acquisition from a sampling of vehicle sensors, the computer program product comprising a non-transitory computer storage medium having instructions embodied thereon, which when executed by a computer cause the computer to:

identify a vehicle population density representing a number of vehicles in a defined region, each of the vehicles corresponding to the vehicle population density having communication components configured to communicate with the computer;

calculate a proportional representation ratio as a percentage of the vehicle population density;

transmit, via at least one of a base station and a satellite system, a request for the data over a network, the request including response criteria configured with the proportional representation ratio, the response criteria specifying which vehicles, of the number of vehicles, are directed to respond with the data; and receive the data from the vehicles in the defined region that fall within the proportional representation ratio, and which meet the response criteria.

19. The computer program product of claim 18, wherein the vehicle population density is calculated from population density census data in combination with previously transmitted responses to requests for the data and a number of roads in the defined region; and wherein the proportional representation ratio is a function of an anticipated volume of vehicles in the defined region at a point in time.

20. The computer program product of claim 18, wherein the network is at least one of an FM broadcast network and a radio data system protocol-enabled broadcast network, and the response criteria is used to filter a number of the vehicles for responding to the request.

* * * * *